US011071181B2

(12) United States Patent
Yu

(10) Patent No.: US 11,071,181 B2
(45) Date of Patent: Jul. 20, 2021

(54) ADAPTIVE DIMMING CIRCUIT AND A METHOD THEREOF

(71) Applicant: Chengdu Monolithic Power Systems Co., Ltd., Chengdu (CN)

(72) Inventor: Bo Yu, Hangzhou (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 0 days.

(21) Appl. No.: 17/098,730

(22) Filed: Nov. 16, 2020

(65) Prior Publication Data

US 2021/0160978 A1 May 27, 2021

(30) Foreign Application Priority Data

Nov. 27, 2019 (CN) ..... 201911180319.6

(51) Int. Cl.
*H05B 45/10* (2020.01)
*H05B 45/14* (2020.01)
*H05B 45/46* (2020.01)

(52) U.S. Cl.
CPC ..... *H05B 45/14* (2020.01); *H05B 45/46* (2020.01)

(58) Field of Classification Search
CPC ..... H05B 45/00; H05B 45/10; H05B 45/14; H05B 45/46
See application file for complete search history.

(56) References Cited

U.S. PATENT DOCUMENTS

| | | | | |
|---|---|---|---|---|
| 8,098,018 | B2 | 1/2012 | Liu et al. | |
| 8,604,710 | B2 | 12/2013 | Yu et al. | |
| 9,408,272 | B2 | 8/2016 | Lian | |
| 2009/0322234 | A1* | 12/2009 | Chen | H05B 45/38 315/159 |
| 2012/0104964 | A1 | 5/2012 | Hughes | |
| 2013/0293154 | A1 | 11/2013 | Kuang et al. | |
| 2015/0076999 | A1* | 3/2015 | Malinin | H05B 45/24 315/186 |

* cited by examiner

*Primary Examiner* — Jimmy T Vu
(74) *Attorney, Agent, or Firm* — Perkins Coie LLP

(57) ABSTRACT

A dimming module having: a calculating circuit, configured to receive a preset current duty cycle reference signal, a preset current magnitude reference signal and a feedback voltage of an associated light-emitting device string, and to provide a current duty cycle reference signal and a current magnitude reference signal; and a current regulating circuit, configured to receive the feedback voltage of the associated light-emitting device string, the current duty cycle reference signal and the current magnitude reference signal, and to control a duty cycle and a magnitude of the current flowing through the associated light-emitting device string; wherein the current magnitude reference signal provided to the light-emitting device string with the minimum feedback voltage is lower than the preset current magnitude reference signal, while the current magnitude reference signal provided to each other light-emitting device string is higher than the preset current magnitude reference signal.

19 Claims, 5 Drawing Sheets

ADAPTIVE DIMMING CIRCUIT AND A METHOD THEREOF

CROSS-REFERENCE TO RELATED APPLICATIONS

This application claims priority to and the benefit of Chinese Patent Application No. 201911180319.6, filed on Nov. 27, 2019, which is incorporated herein by reference in its entirety.

FIELD

The present invention relates generally to electronic circuits, and more particularly but not exclusively to a dimming circuit for light-emitting devices and a method thereof.

BACKGROUND

Light-emitting devices, especially light-emitting diodes (LED), are widely adopted by the today's electronic products, e.g., architectural lighting, vehicle lights, backlighting of mobile phone and computer screen. To meet the different brightness requirements of different applications, light-emitting device dimming is necessary. Different dimming methods are used according to the characteristic of the light-emitting device. For LED, the brightness of the LED depends on an average current flowing through the LED. That is to say, LED dimming could be realized by regulating the average current flowing through the LED.

In a backlighting system, LEDs are arranged in multiple paralleled strings, and the multiple paralleled LED strings are powered by a LED driver. The currents flowing through the LED strings are regulated by a dimming circuit. The LED driver and the dimming circuit constitute a LED driving system. However, the forward voltage of each LED is slightly different due to the difference caused by the LED manufacturing process. When the LEDs are arranged in a string, the difference is superimposed, resulting in inconsistent forward voltages of the multiple LED strings.

Therefore, a system providing smart dimming and proper driving voltage is necessary, to improve both the LED efficiency and the LED driver efficiency.

SUMMARY

It is an object of the present invention to provide a light-emitting device driving system, which could provide a proper driving voltage and smart dimming to the multiple light-emitting device strings, and further has high efficiency.

In accomplishing the above and other objects, there has been provided, in accordance with an embodiment of the present invention, a dimming module comprising: a plurality of calculating circuits, wherein each calculating circuit is configured to receive a preset current duty cycle reference signal, a preset current magnitude reference signal and a feedback voltage of an associated light-emitting device string of a plurality of light-emitting device strings, and wherein based on the preset current duty cycle reference signal, the preset current magnitude reference signal and the feedback voltage of the associated light-emitting device string, the calculating circuit provides a current duty cycle reference signal and a current magnitude reference signal for controlling the associated light-emitting device string; and a plurality of current regulating circuits, wherein each current regulating circuit is configured to receive the feedback voltage of the associated light-emitting device string, the current duty cycle reference signal and the current magnitude reference signal for the associated light-emitting device string, and wherein based on the current duty cycle reference signal, the current regulating circuit controls a duty cycle of a current flowing through the associated light-emitting device string, and wherein based on the feedback voltage and the current magnitude reference signal, the current regulating circuit controls a magnitude of the current flowing through the associated light-emitting device string; wherein the current magnitude reference signal provided to the light-emitting device string with a minimum feedback voltage is lower than the preset current magnitude reference signal, while the current magnitude reference signal provided to each other light-emitting device string is higher than the preset current magnitude reference signal.

In accomplishing the above and other objects, there has been provided, in accordance with an embodiment of the present invention, a light-emitting device driving system for driving a plurality of light-emitting device strings, comprising: a dimming circuit having a plurality of dimming modules, wherein each dimming module receives a preset current duty cycle reference signal, a preset current magnitude reference signal and a feedback voltage of an associated light-emitting device string, and wherein based on the preset current duty cycle reference signal, the preset current magnitude reference signal and the feedback voltage, the dimming module provides a current duty cycle reference signal and a current magnitude reference signal, and wherein the current magnitude reference signal provided to the light-emitting device string with a minimum feedback voltage is lower than the preset current magnitude reference signal, while the current magnitude reference signal provided to each other light-emitting device string is higher than the preset current magnitude reference signal; a feedback amplifying circuit, configured to receive a reference signal and the minimum feedback voltage of the feedback voltages of light-emitting device strings, and based on the reference signal and the minimum feedback voltage, the feedback amplifying circuit provides a compensation signal; and a pulse generating circuit, configured to receive the compensation signal, and based on the compensation signal, the pulse generating circuit provides a power controlling signal to control power provided to the light-emitting device strings.

In accomplishing the above and other objects, there has been provided, in accordance with an embodiment of the present invention, a dimming control method for controlling a plurality of light-emitting device strings, comprising: receiving a preset current magnitude reference signal and a preset current duty cycle reference signal; detecting a minimum feedback voltage from feedback voltages of the light-emitting device strings; clamping the minimum feedback voltage to a lower threshold by regulating a current flowing through the associated light-emitting device string; decreasing the current magnitude reference signal of the light-emitting device string with the minimum feedback voltage from the preset current magnitude reference signal; increasing the current magnitude reference signal of the light-emitting device string without the minimum feedback voltage from the preset current magnitude reference signal; and adjusting a current duty cycle reference signal according to the current magnitude reference signal to maintain the current flowing through the associated light-emitting device string being a preset value; wherein the preset value of the current flowing through the light-emitting device string is proportional to a product of the preset current magnitude reference signal and the preset current duty cycle reference signal.

The use of the same reference label in different drawings indicates the same or like components.

DETAILED DESCRIPTION

In the present invention, numerous specific details are provided, such as examples of circuits, components, and methods, to provide a thorough understanding of embodiments of the invention. Persons of ordinary skill in the art would recognize, however, that the invention can be practiced without one or more of the specific details. In other instances, well-known details are not shown or described to avoid obscuring aspects of the invention.

The embodiments in the present invention use specific implementation circuits and application as examples to illustrate the dimming circuits and dimming methods, so that persons skilled in the art can better understand the present invention. However, persons skilled in the art should understand that these descriptions are only exemplary and not intended to limit the scope of the present invention.

The present invention uses LED driving as an example to illustrate the structure and working principle of a light-emitting device driving system. It should be understood that the driving system described in the present invention is also applicable to driving other light-emitting devices except LEDs.

Figure 1:
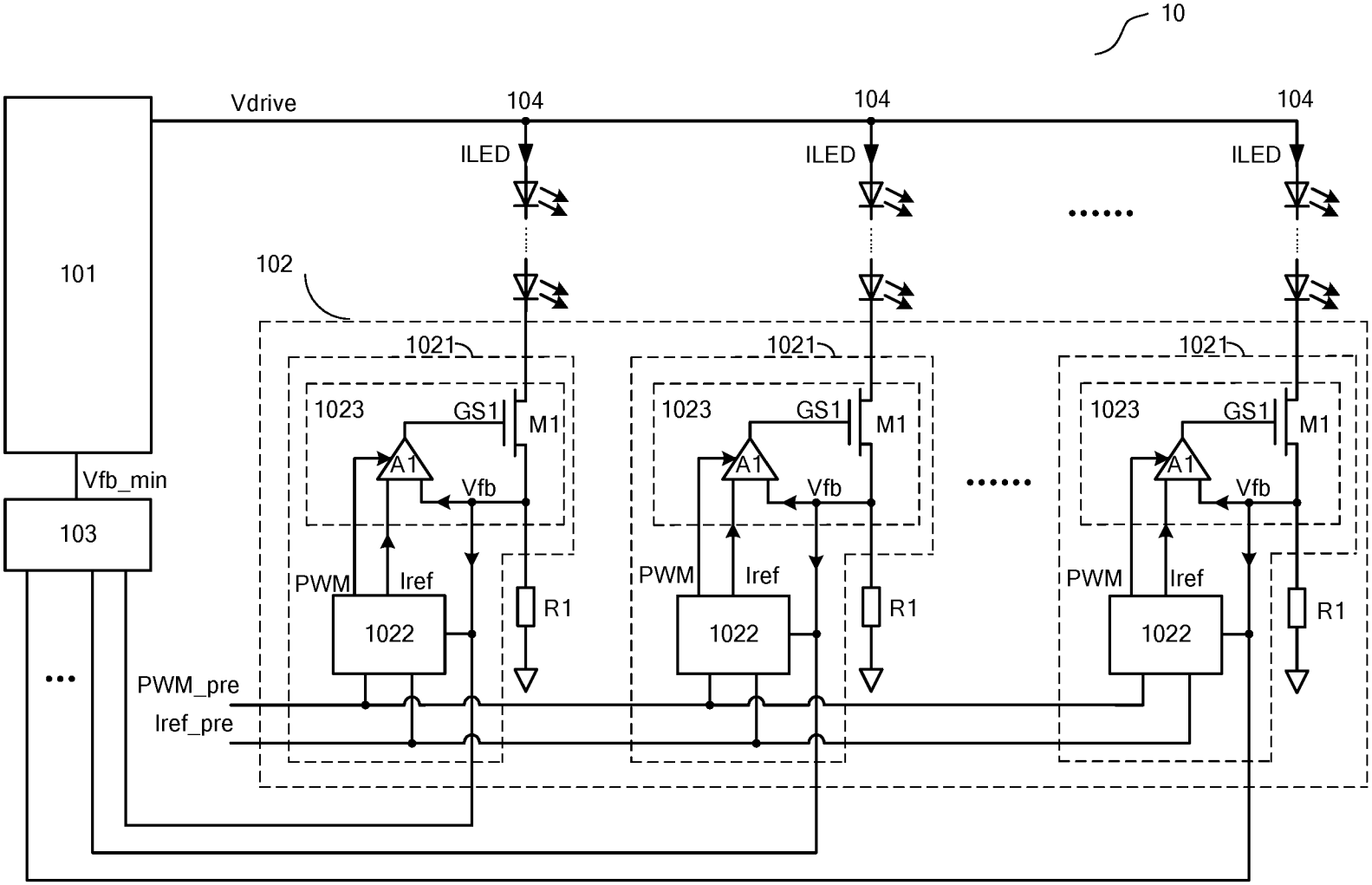
FIG. 1 schematically shows block diagram of a LED driving system 10 in accordance with an embodiment of the present invention.

FIG. 1 schematically shows block diagram of a LED driving system 10 in accordance with an embodiment of the present invention. The LED driving system 10 is adopted to drive the LED strings 104. As shown in FIG. 1, the LED driving system 10 comprises: a driving circuit 101, providing a driving voltage Vdrive to the LED strings 104; a dimming circuit 102, coupled to the LED strings 104, for regulating currents flowing through the LED strings 104; a feedback circuit 103, receiving the feedback voltages Vfb of the LED strings 104, and selecting a minimum feedback voltage Vfb_min to the driving circuit 101. Each of the feedback voltages Vfb indicates the current ILED flowing through the associated LED string. In one embodiment of the present invention, the feedback voltage Vfb is generated by flowing the current ILED of the LED string to a resistor R1 coupled in series to the LED string. The driving circuit 101 receives the minimum feedback voltage Vfb_min, and provides a driving voltage Vdrive for driving the LED strings 104 based on the minimum feedback voltage Vfb_min.

In the example of FIG. 1, the dimming circuit 102 comprises a plurality of dimming modules 1021. Each dimming module 1021 is coupled to one of the LED strings 104. As shown in FIG. 1, the dimming module 1021 comprises: a calculating circuit 1022, configured to receive a preset current duty cycle reference signal PWM_pre, a preset current magnitude reference signal Iref_pre and a feedback voltage Vfb of an associated LED string of the LED strings 104, and based on the preset current duty cycle reference signal PWM_pre, the preset current magnitude reference signal Iref_pre and the feedback voltage Vfb of the associated LED string of the LED strings 104, the calculating circuit 1022 provides a current duty cycle reference signal PWM and a current magnitude reference signal Iref; and a current regulating circuit 1023, configured to receive the feedback voltage Vfb, the current duty cycle reference signal PWM and the current magnitude reference signal Iref of the associated LED string, wherein based on the current duty cycle reference signal PWM, the current regulating circuit 1023 controls a duty cycle of the current ILED flowing through the associated LED string, and wherein based on the feedback voltage Vfb and the current magnitude reference signal Iref, the current regulating circuit 1023 controls a magnitude of the current ILED flowing through the associated LED string; wherein, the current magnitude reference signal Iref provided to the LED string with the minimum feedback voltage Vfb_min is lower than the preset current magnitude reference signal Iref_pre, while the current magnitude reference signal Iref provided to each other LED strings is higher than the preset current magnitude reference signal Iref_pre.

The preset current magnitude reference signal Iref_pre and the preset current duty cycle reference signal PWM_pre may be set by off-chip signals, or by an upper-level system. In one embodiment of the present invention, the current duty cycle reference signal PWM, the current magnitude reference signal Iref, the preset current duty cycle reference signal PWM_pre and the preset current magnitude reference signal Iref_pre have a relationship of Iref×PWM=Iref_pre× PWM_pre.

In one embodiment of the present invention, the calculating circuit 1022 comprises a storage unit, e.g., registers, lookup tables. The storage unit may comprise several different values for the current magnitude reference signal Iref. In one embodiment of the present invention, the values in the storage unit are arranged to have a step of 5 mA between two adjacent values, and have an upper limit Iref_max and a lower limit Iref_min. Persons of ordinary skill in the art could set the step between two adjacent values, the upper limit Iref_max and the lower limit Iref_min of the said values according to the application. In one embodiment of the present invention, the current duty cycle reference signal PWM could be obtained by an equation PWM=Iref_pre× PWM_pre/Iref. In one embodiment of the present invention, the storage unit of the calculating circuit 1022 contains a plurality of values for the current duty cycle reference signal PWM. After calculating the value of the current duty cycle reference signal PWM by the equation PWM=Iref_pre× PWM_pre/Iref, the final value of the current duty cycle reference signal PWM will be the value in the storage unit which is mostly close to calculated value.

In one embodiment of the present invention, the current duty cycle reference signal PWM has an upper limit PWM_max and a lower limit PWM_min. When the current magnitude reference signal Iref of an associated LED string increases, the current duty cycle reference signal PWM of the associated LED string decreases, to maintain an equivalent average current flowing through the associated LED string constant. When the current duty cycle reference signal PWM decreases to the lower limit PWM_min, the current magnitude reference signal Iref stops regulation. When the current magnitude reference signal Iref decreases, the current duty cycle reference signal PWM increases, to maintain the equivalent average current flowing through the LED string constant. When the current duty cycle reference signal PWM increases to the upper limit PWM_max, the current magnitude reference signal Iref stops regulation.

In one embodiment of the present invention, the current magnitude reference signal Iref has the upper limit Iref_max and the lower limit Iref_min, and meanwhile, the current duty cycle reference signal PWM has the upper limit PWM_max and the lower limit PWM_min. To maintain the equivalent average current flowing through the LED string being constant, the current duty cycle reference signal PWM increases as the associated current magnitude reference signal Iref decreases, and decreases as the associated current magnitude reference signal Iref increases. Once the current duty cycle reference signal PWM reaches the upper limit PWM_max or the lower limit PWM_min, the regulations to the current duty cycle reference signal PWM and the associated current magnitude reference signal Iref stop. Similarly, once the current magnitude reference signal Iref reaches the upper limit Iref_max or the lower limit Iref_min, the regulations to the current magnitude reference signal Iref and the associated current duty cycle reference signal PWM stop too.

The calculation circuit 1022 could be implemented by digital circuit based on hardware description language, e.g., Verilog, VHDL.

In the example of FIG. 1, the current regulating circuit 1023 comprises: an amplifier A1, configured to receive the feedback voltage Vfb, the current duty cycle reference signal PWM and the current magnitude reference signal Iref of the associated LED string, wherein based on the feedback voltage Vfb, the current duty cycle reference signal PWM and the current magnitude reference signal Iref, the amplifier A1 provides a dimming control signal GS1; and a dimming switch M1, coupled in series to the LED string, wherein the dimming switch M1 receives the dimming control signal GS1 and is controlled by the dimming control signal GS1.

The current duty cycle reference signal PWM is a square wave signal or a pulse signal. In one embodiment of the present invention, the amplifier A1 is enabled when current duty cycle reference signal PWM is high. The amplifier A1 has a non-inverting input terminal configured to receive the current magnitude reference signal Iref, an inverting input terminal configured to receive the feedback voltage Vfb, and based on the amplifying result of the current magnitude reference signal Iref and the feedback voltage Vfb, the amplifier A1 provides the dimming control signal GS1 at an output terminal. The amplifier A1 clamps the feedback voltage Vfb to the current magnitude reference signal Iref, makes the current flowing through the resistor R1, i.e., the current ILED flowing through the LED string, be ILED=Iref/R1.

In the example of FIG. 1, the LED driving system 10 comprises a feedback circuit 103, configured to receive the feedback voltages Vfb from the LED strings 104, and to provide the minimum feedback voltage Vfbmin of the feedback voltages Vfb to the driving circuit 101. In real application, the forward voltages of the LEDs may be slightly different. When the LEDs are coupled in a string, the slight differences may be superimposed, resulting in inconsistent forward voltage VLED required by each LED string. When all the LED stings are drove by the common driving voltage Vdrive, the feedback voltages Vfb, which is Vfb=Vdrive-VLED (the voltage on the feedback resistor R1 is ignored) for each LED string, are different. To assure high enough driving voltage, the minimum feedback voltage Vfb_min is adopted to regulate the driving voltage Vdrive.

Figure 2A:
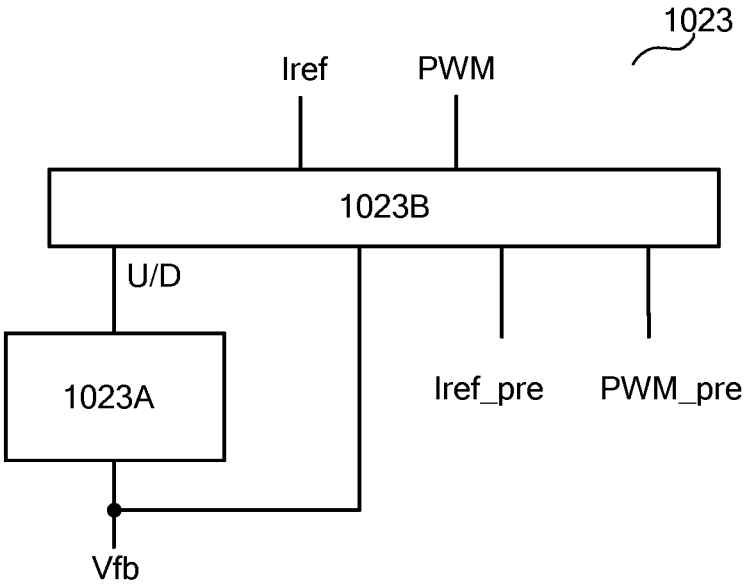
FIG. 2A schematically shows a calculating circuit 1023 in accordance with an embodiment of the present invention.

FIG. 2A schematically shows a calculating circuit 1023 in accordance with an embodiment of the present invention. The calculating circuit 1023 comprises: a feedback voltage detecting circuit 1023A, configured to receive the feedback voltage Vfb of the associated LED string, and provide a minimum feedback voltage indicating signal U/D, wherein the minimum feedback voltage indicating signal U/D indicates if the feedback voltage Vfb of the associated LED string is the minimum feedback voltage Vfb_min; and a current setting circuit 1023B, configured to receive the minimum feedback voltage indicating signal U/D, the feedback voltage Vfb, the preset current magnitude reference signal Iref_pre and the preset current duty cycle reference signal PWM_pre, and based on the minimum feedback voltage indicating signal U/D, the feedback voltage Vfb, the preset current magnitude reference signal Iref_pre and the preset current duty cycle reference signal PWM_pre, the current setting circuit 1023B provides the current magnitude reference signal Iref and the current duty cycle reference signal PWM for the associated LED string.

In the example of FIG. 2A, the feedback voltage detecting circuit 1023A receives the feedback voltage Vfb, and determines if the received feedback voltage Vfb is the minimum feedback voltage Vfb_min, and then provides the minimum feedback voltage indicating signal U/D to indicate if the received feedback voltage Vfb is the minimum feedback voltage Vfb_min.

The LED string with the minimum feedback voltage Vfb_min is processed differently from the other LED strings. When the minimum feedback voltage indicating signal U/D indicates that the associated LED string has the minimum feedback voltage Vfb_min, the current magnitude reference signal Iref provided by the current setting circuit 10238 decreases step by step from the preset current magnitude reference signal Iref_pre, and the current duty cycle reference signal PWM increases accordingly, until the current magnitude reference signal Iref reaches the lower limit Iref_min. When the minimum feedback voltage indicating signal U/D indicates that the associated LED string has the feedback voltage higher than the minimum feedback voltage Vfb_min, the current magnitude reference signal Iref provided by the current setting circuit 10238 increases step by step from the preset current magnitude reference signal Iref_pre, and the current duty cycle reference signal PWM decreases accordingly, until the current magnitude reference signal Iref reaches the upper limit Iref_max, or the feedback voltage Vfb reaches a lower threshold Vmin. In the embodiments both the current magnitude reference signal Iref and the current duty cycle reference signal PWM have upper limits and lower limits, the regulation stops when any limit is reached. In some embodiments of the present invention, the current duty cycle reference signal PWM has the upper limit PWM_max and the lower limit PWM_min, or the feedback voltage Vfb has the lower threshold Vmin, while no limit for the current magnitude reference signal Iref. Based on the same principle, the regulations to the current duty cycle reference signal PWM, the current magnitude reference Iref stop when any limit to the current duty cycle reference signal PWM or the feedback voltage Vfb is reached.

The values of the upper limit Iref_max, the lower limit Iref_min for the current magnitude reference signal Iref, the values of the upper limit PWM_max, the lower limit PWM_min for the current duty cycle reference signal PWM, and the value of the lower threshold Vmin for the feedback voltage Vfb are set by the current setting circuit 1023B according to the application requirements. In one embodiment of the present invention, the upper limit Iref_max for the current magnitude reference Iref is set to be 20% higher than the preset current magnitude reference Iref_pre, and the lower limit Iref_min is set to be 20% lower than the preset current magnitude reference Iref_pre, i.e., Iref_max=lref_pre×(1+20%), and Iref_min=lref_pre×(1-20%). Similarly, the upper limit PWM_max and the lower limit PWM_min of the current duty cycle reference PWM could be respectively set to be 20% higher than the preset current duty cycle reference signal PWM_pre and 20% lower than the preset current duty cycle reference signal PWM_pre. The lower threshold Vmin of the feedback voltage Vfb could be set to be slightly higher than or equal to the minimum feedback voltage Vfb_min during the steady working state of the LED driving system. For example, the lower threshold Vmin could be 0.21V or 0.2V when the minimum feedback voltage Vfb_min is 0.2V in the steady working state of the LED driving system.

Figure 2B:
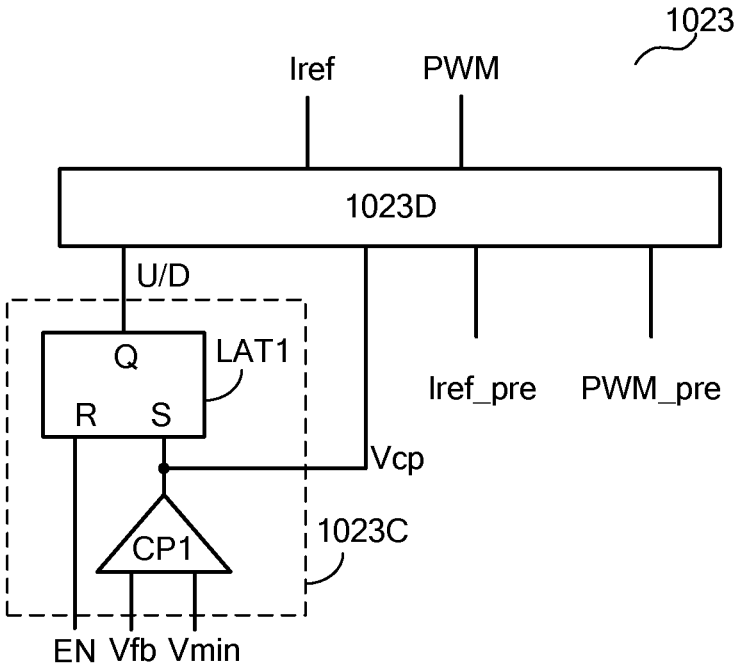
FIG. 2B schematically shows a calculating circuit 1023 in accordance to an embodiment of the present invention.

FIG. 2B schematically shows a calculating circuit 1023 in accordance to an embodiment of the present invention. The calculating circuit 1023 comprises: a feedback voltage detecting circuit 1023C, configured to receive a startup enable signal EN, the feedback voltage Vfb of the associated LED string, and the lower threshold Vmin of the feedback voltage Vfb, wherein based on the feedback voltage Vfb and the lower threshold Vmin, the feedback voltage detecting circuit 1023C provides a comparison signal Vcp, and wherein based on the comparison signal Vcp and the startup enable signal EN, the feedback voltage detecting circuit 1023C provides the minimum feedback voltage indicating signal U/D, wherein the minimum feedback voltage indicating signal U/D indicates if the feedback voltage Vfb of the associated LED string is the minimum feedback voltage Vfb_min; and a current setting circuit 1023D, configured to receive the minimum feedback voltage indicating signal U/D, the comparison signal Vcp, the preset current magnitude reference signal Iref_pre and the preset current duty cycle reference signal PWM_pre, and based on the minimum feedback voltage indicating signal U/D, the comparison signal Vcp, the preset current magnitude reference signal Iref_pre and the preset current duty cycle reference signal PWM_pre, the current setting circuit 1023D provides the current magnitude reference signal Iref and the current duty cycle reference signal PWM. In the example of FIG. 2B, the startup enable signal EN could be any signal that could indicates the startup or re-startup of the LED driving system.

In the embodiment of FIG. 2B, the feedback voltage detecting circuit 1023C comprises: a comparator CP1, configured to receive the feedback voltage Vfb of the associated LED string and the lower threshold Vmin, and based on the feedback voltage Vfb and the lower threshold Vmin, the comparator CP1 provides a comparison signal Vcp; and a latch circuit LAT1, configured to receive the startup enable signal EN and the comparison signal Vcp, and based on the startup enable signal EN and the comparison signal, the latch circuit LAT1 provides the minimum feedback voltage indicating signal U/D.

When the LED driving system starts up, the startup enable signal EN resets all the minimum feedback voltage indicating signals U/D. When the startup period is over, the minimum feedback voltage indicating signal U/D of the LED string with the minimum feedback voltage Vfb_min flips. Then the current setting circuit 1023D regulates the current magnitude reference signal Iref and the current duty cycle reference signal PWM based on the minimum feedback voltage indicating signals U/D.

The operation of the current setting circuit 1023D is similar to the operation of the current setting circuit 1023B in FIG. 2A. The difference is: the current setting circuit 1023B in FIG. 2A compares the feedback voltage Vfb with the lower threshold Vmin to determine if the feedback voltage Vfb decreases to the lower threshold Vmin, while the current setting circuit 1023D in FIG. 2B determines if the feedback voltage Vfb decreases to the lower threshold Vmin based on the received comparison signal Vcp.

Figure 2C:
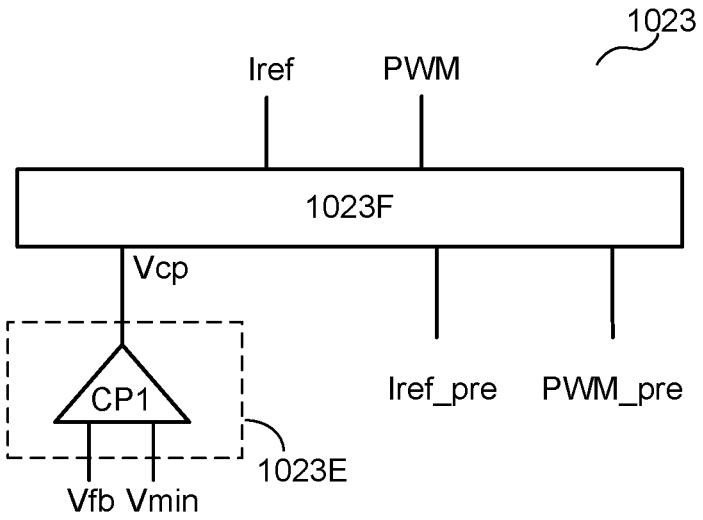
FIG. 2C schematically shows the calculating circuit 1023 in accordance with an embodiment of the present invention.

FIG. 2C schematically shows the calculating circuit 1023 in accordance with an embodiment of the present invention. The calculating circuit 1023 comprises: a feedback voltage detecting circuit 1023E, configured to receive the feedback voltage Vfb of the associated LED string, and lower threshold Vmin of the feedback voltage Vfb, and based on the feedback voltage Vfb and the lower threshold Vmin, the feedback voltage detecting circuit 1023E provides the comparison signal Vcp; and a current setting circuit 1023F, configured to receive the comparison signal Vcp, the preset current magnitude reference signal Iref_pre and the preset current duty cycle reference signal PWM_pre, and based on the comparison signal Vcp, the preset current magnitude reference signal Iref_pre and the preset current duty cycle reference signal PWM_pre, the current setting circuit 1023F provides the current magnitude reference signal Iref and the current duty cycle reference signal PWM.

In the example of FIG. 2C, the feedback voltage detecting circuit 1023E comprises: the comparator CP1, configured to receive the feedback voltage Vfb of the associated LED string and the lower threshold Vmin of the feedback voltage Vfb, wherein based on the feedback voltage Vfb and the lower threshold Vmin, the comparator CP1 provides the comparison signal Vcp to the current setting circuit 1023F.

The operation of the current setting circuit 1023F is similar to the operation of the current setting circuit 1023B in FIG. 2A and the current setting circuit 1023D in FIG. 2B. The difference is: the current setting circuit 1023F in FIG. 2C determines the LED string with the minimum feedback voltage Vfb_min and whether the feedback voltage Vfb decreases to the lower threshold Vmin based on the comparison signal Vcp. In one embodiment of the present invention, once the LED string with the minimum feedback voltage Vfb_min is determined, the state is maintained and is not affected by the change of the comparison signal Vcp.

It should be understood that, any circuit could detect the LED string with the minimum feedback voltage Vfb_min, or any circuit could detect the LED string with the largest forward voltage VLED, is applicable to the present invention. In some embodiments of the present invention, the feedback voltage detecting circuit may have other structures, or may be implemented by digital circuit generated by hard ware description language.

Figure 3:
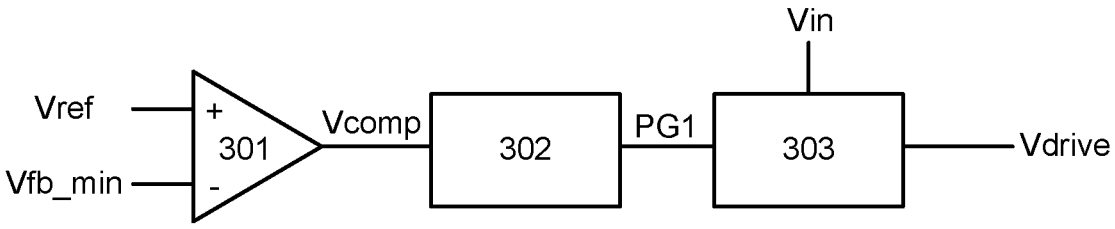
FIG. 3 schematically shows a driving circuit 30 in accordance with an embodiment of the present invention.

FIG. 3 schematically shows a driving circuit 30 in accordance with an embodiment of the present invention. As shown in FIG. 3, the driving circuit 30 comprises: a feedback amplifying circuit 301, configured to receive a reference signal Vref and the minimum feedback voltage Vfb_min, wherein based on the reference signal Vref and the minimum feedback voltage Vfbmin, the feedback amplifying circuit 301 provides a compensation signal Vcomp; a pulse generating circuit 302, configured to receive the compensation signal Vcomp, and based on the compensation signal Vcomp, the pulse generating circuit 302 provides a power controlling signal PG1; and a power circuit 303, configured to receive the power controlling signal PG1 and an input voltage Vin of the driving circuit 30, wherein the power circuit 303 converts the input voltage Vin to the driving voltage Vdrive under the control of the power controlling signal PG1.

The power circuit 303 comprises Boost converter, Buck-Boost converter, Buck converter, or power converting circuit with other topology. The pulse generating circuit 302 comprises a control circuit for the power circuit 303.

Figure 4:
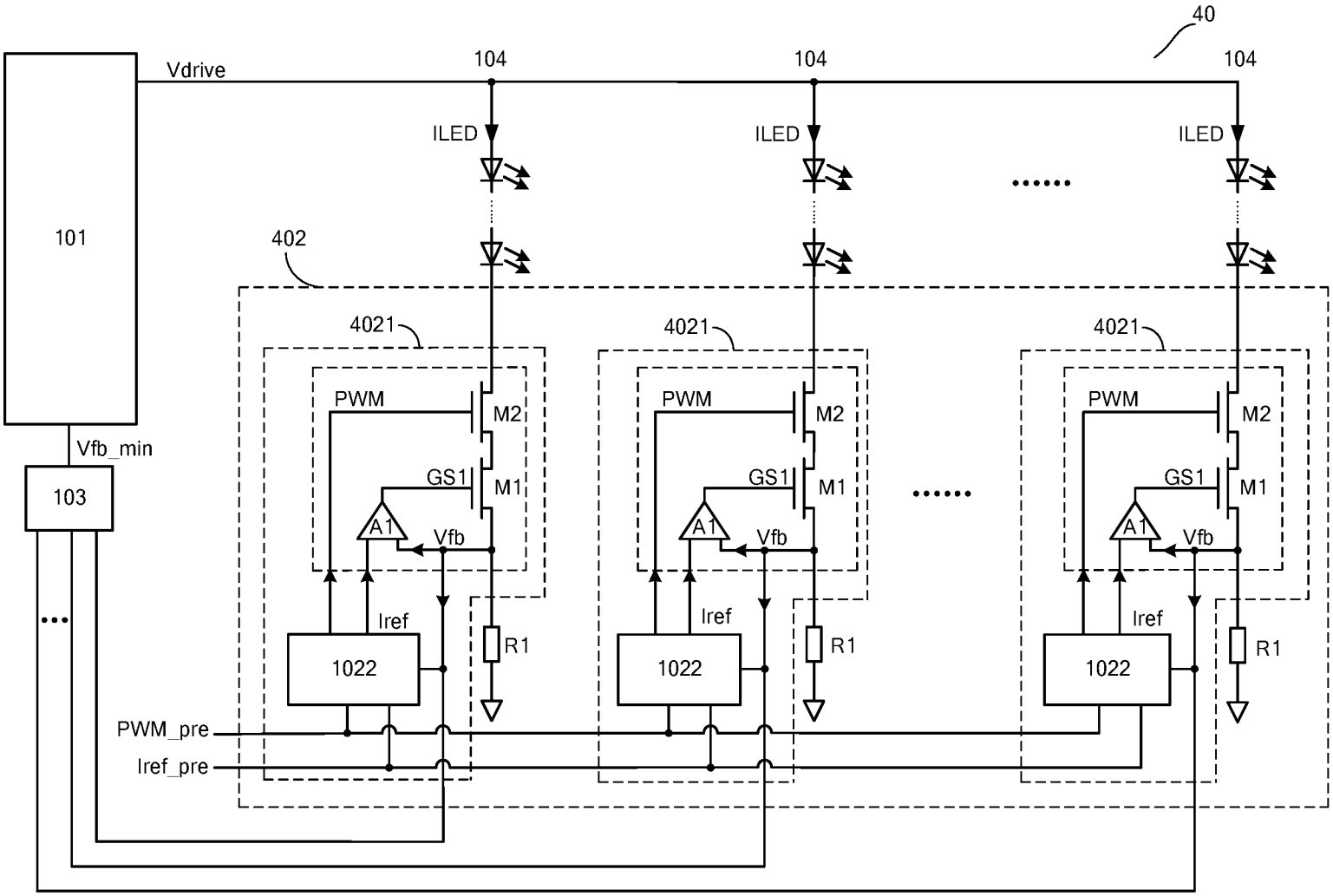
FIG. 4 schematically shows a light-emitting device driving system 40 in accordance with an embodiment of the present invention.

FIG. 4 schematically shows a LED driving system 40 in accordance with an embodiment of the present invention. The LED driving system 40 is similar with the LED driving system 10 except for the dimming circuit 402. In FIG. 4, the dimming circuit 402 has a current regulating circuit 4023 comprising: an amplifier A1, configured to receive the feedback voltage Vfb of the associated LED string and the current magnitude reference signal Iref for the associated LED string, wherein based on the feedback voltage Vfb and the current magnitude reference signal Iref, the amplifier A1 provides the dimming control signal GS1; the dimming switch M1, coupled in series to the LED string, wherein the dimming switch M1 receives the dimming control signal GS1 and is controlled by the dimming control signal GS1; and another dimming switch M2, coupled in series to the LED string and the dimming switch M1, wherein the dimming switch M2 receives the current duty cycle control switch PWM and is controlled by the current duty cycle control switch PWM.

Different from the current regulating circuit 1023 in FIG. 1, the current duty cycle reference signal PWM is not used for enabling/disabling the amplifier A1. Instead, the current duty cycle reference signal PWM is used for controlling the on and off of the dimming switch M2. The operation of the current regulating circuit 4023 is similar with the operation of the current regulating circuit 1023, and is not described here for brevity.

Figure 5:
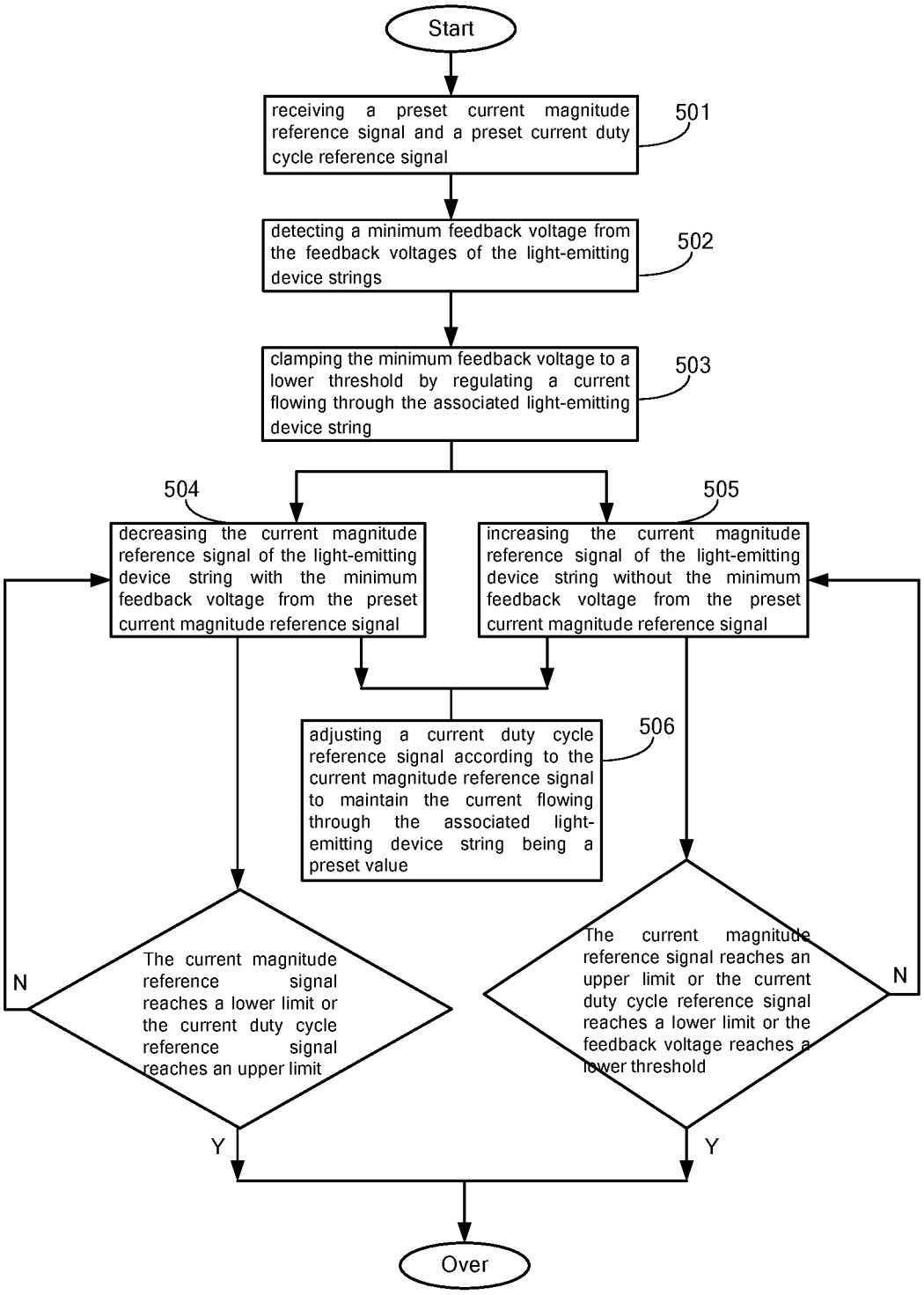
FIG. 5 shows a flow chart of a dimming control method 50 of light-emitting devices in accordance with an embodiment of the present invention.

FIG. 5 shows a flow chart of a dimming control method 50 of light-emitting devices, like LEDs. The dimming control method 50 could be adopted by the LED driving systems 10 and 40. The dimming control method 50 comprises:

Step 501, receiving a preset current magnitude reference signal and a preset current duty cycle reference signal;

Step 502, detecting a minimum feedback voltage from the feedback voltages of the light-emitting device strings, wherein each feedback voltage indicates a current flowing through an associated light-emitting device string;

Step 503, clamping the minimum feedback voltage to a lower threshold by regulating a current flowing through the associated light-emitting device string;

Step 504, decreasing the current magnitude reference signal of the light-emitting device string with the minimum feedback voltage from the preset current magnitude reference signal;

Step 505, increasing the current magnitude reference signal of the light-emitting device string without the minimum feedback voltage from the preset current magnitude reference signal; and Step 506, adjusting a current duty cycle reference signal according to the current magnitude reference signal to maintain a current flowing through the associated light-emitting device string being a preset value; wherein The preset value of the current for each light-emitting device string is proportional to the product of the preset current magnitude reference signal and the preset current duty cycle reference signal.

In one embodiment of the present invention, the step 504 further comprises: stopping regulating the current magnitude reference signal when the current magnitude reference signal of the light-emitting device string with the minimum feedback voltage reaches a lower limit.

In one embodiment of the present invention, the step 504 further comprises: stopping regulating the current magnitude reference signal when the current duty cycle reference signal of the light-emitting device string with the minimum feedback voltage reaches an upper limit.

In one embodiment of the present invention, the step 504 further comprises: stopping regulating the current magnitude reference signal of the light-emitting device string with the minimum feedback voltage when any one of the following conditions is met: (1) the current magnitude reference signal of the associated light-emitting device string reaches the lower limit of the current magnitude reference signal; (2) the current duty cycle reference signal of the associated light-emitting device string reaches the upper limit of the current duty cycle reference signal.

In one embodiment of the present invention, the step 505 further comprises: stopping regulating the current magnitude reference signal of the light-emitting device string without the minimum feedback voltage when any one of the following conditions is met: (1) the current magnitude reference signal of the light-emitting device string without the minimum feedback voltage reaches an upper limit of the current magnitude reference signal; (2) the feedback voltage of the light-emitting device string without the minimum feedback voltage reaches the lower threshold.

In one embodiment of the present invention, the step 505 further comprises: stopping regulating the current magnitude reference signal of the associated Light-emitting device string without the minimum feedback voltage when any one of the following conditions is met: (1) the current duty cycle reference signal of the associated light-emitting device string reaches the lower limit of the current duty cycle reference signal; (2) the feedback voltage of the light-emitting device string of the associated Light-emitting device string reaches the lower threshold.

In one embodiment of the present invention, the step 505 further comprises: stopping regulating the current magnitude reference signal of the associated light-emitting device string without the minimum feedback voltage when any one of the following conditions is met: (1) the current magnitude reference signal of the associated light-emitting device string reaches the upper limit of the current magnitude reference signal; (2) the current duty cycle reference signal of the associated light-emitting device string reaches the lower limit of the current duty cycle reference signal; (3) the feedback voltage of the associated light-emitting device string reaches the lower threshold.

Obviously many modifications and variations of the present invention are possible in light of the above teachings. It is therefore to be understood that within the scope of the appended claims the invention may be practiced otherwise than as specifically described. It should be understood, of course, the foregoing disclosure relates only to a preferred embodiment (or embodiments) of the invention and that numerous modifications may be made therein without departing from the spirit and the scope of the invention as set forth in the appended claims. Various modifications are contemplated and they obviously would be resorted to by those skilled in the art without departing from the spirit and the scope of the invention as hereinafter defined by the appended claims as only a preferred embodiment(s) thereof has been disclosed.

What is claimed is:

1. A dimming module comprising:

a plurality of calculating circuits, wherein each calculating circuit is configured to receive a preset current duty cycle reference signal, a preset current magnitude reference signal and a feedback voltage of an associated light-emitting device string of a plurality of light-emitting device strings, and wherein based on the preset current duty cycle reference signal, the preset current magnitude reference signal and the feedback voltage of the associated light-emitting device string, the calculating circuit provides a current duty cycle reference signal and a current magnitude reference signal for controlling the associated light-emitting device string; and a plurality of current regulating circuits, wherein each current regulating circuit is configured to receive the feedback voltage of the associated light-emitting device string, the current duty cycle reference signal and the current magnitude reference signal for the associated light-emitting device string, and wherein based on the current duty cycle reference signal, the current regulating circuit controls a duty cycle of a current flowing through the associated light-emitting device string, and wherein based on the feedback voltage and the current magnitude reference signal, the current regulating circuit controls a magnitude of the current flowing through the associated light-emitting device string; wherein the current magnitude reference signal provided to the light-emitting device string with a minimum feedback voltage is lower than the preset current magnitude reference signal, while the current magnitude reference signal provided to each other light-emitting device string is higher than the preset current magnitude reference signal.

2. The dimming module of claim 1, wherein the current flowing through the associated light-emitting device string is a preset value proportional to a product of the preset current magnitude reference signal and the preset current duty cycle reference signal.

3. The dimming module of claim 1, wherein the current duty cycle reference signal of the light-emitting device string increases as the associated current magnitude reference signal decreases, and decreases as the associated current magnitude reference signal increases.

4. The dimming module of claim 1, wherein the calculating circuit comprises:

a feedback voltage detecting circuit, configured to receive the feedback voltage of the associated light-emitting device string, and to provide a minimum feedback voltage indicating signal indicating if the feedback voltage of the associated light-emitting device string is the minimum feedback voltage; and a current setting circuit, configured to receive the minimum feedback voltage indicating signal and the feedback voltage of the associated light-emitting device string, the preset current magnitude reference signal and the preset current duty cycle reference signal, wherein based on the minimum feedback voltage indicating signal, the feedback voltage, the preset current magnitude reference signal and the preset current duty cycle reference signal, the current setting circuit provides the current magnitude reference signal and the current duty cycle reference signal to control the current flowing through the associated light-emitting device string.

5. The dimming module of claim 1, wherein the calculating circuit comprises:

a feedback voltage detecting circuit, configured to receive a startup enable signal, the feedback voltage of the associated light-emitting device string, and a lower threshold of the feedback voltages, wherein based on the feedback voltage and the lower threshold, the feedback voltage detecting circuit provides a comparison signal, and wherein based on the comparison signal and the startup enable signal, the feedback voltage detecting circuit provides a minimum feedback voltage indicating signal indicating if the feedback voltage of the associated light-emitting device string is the minimum feedback voltage; and a current setting circuit, configured to receive the minimum feedback voltage indicating signal, the comparison signal, the preset current magnitude reference signal and the preset current duty cycle reference signal, wherein based on the minimum feedback voltage indicating signal, the comparison signal, the preset current magnitude reference signal and the preset current duty cycle reference signal, the current setting circuit provides the current magnitude reference signal and the current duty cycle reference signal to control the current flowing through the associated light-emitting device string.

6. The dimming module of claim 1, wherein the calculating circuit comprises:

a feedback voltage detecting circuit, configured to receive the feedback voltage of the associated light-emitting device string, and a lower threshold of the feedback voltages, wherein based on the feedback voltage and the lower threshold, the feedback voltage detecting circuit provides a comparison signal; and a current setting circuit, configured to receive the comparison signal, the preset current magnitude reference signal and the preset current duty cycle reference signal, wherein based on the comparison signal, the preset current magnitude reference signal and the preset current duty cycle reference signal, the current setting circuit provides the current magnitude reference signal and the current duty cycle reference signal to control the current flowing through the light-emitting device string.

7. The dimming module of claim 1, wherein the current regulating circuit comprises:

an amplifier, configured to receive the feedback voltage of the associated light-emitting device string, the current duty cycle reference signal and the current magnitude reference signal for the associated light-emitting device string, wherein based on the feedback voltage, the current duty cycle reference signal and the current magnitude reference signal, the amplifier provides a dimming control signal; and a dimming switch, coupled in series with the light-emitting device string, wherein the dimming switch receives the dimming control signal and is controlled by the dimming control signal.

8. The dimming module of claim 1, wherein the current regulating circuit comprises:

an amplifier, configured to receive the feedback voltage of the associated light-emitting device string and the current magnitude reference signal for the associated light-emitting device string, wherein based on the feedback voltage and the current magnitude reference signal, the amplifier provides a dimming control signal;

a first dimming switch, coupled in series with the light-emitting device string, wherein the first dimming switch receives the dimming control signal and is controlled by the dimming control signal; and a second dimming switch, coupled in series with the light-emitting device string and the first dimming switch, wherein the second dimming switch receives the current duty cycle reference signal and is controlled by the current duty cycle reference signal.

9. A light-emitting device driving system for driving a plurality of light-emitting device strings, comprising:

a dimming circuit having a plurality of dimming modules, wherein each dimming module receives a preset current duty cycle reference signal, a preset current magnitude reference signal and a feedback voltage of an associated light-emitting device string, and wherein based on the preset current duty cycle reference signal, the preset current magnitude reference signal and the feedback voltage, the dimming module provides a current duty cycle reference signal and a current magnitude reference signal, and wherein the current magnitude reference signal provided to the light-emitting device string with a minimum feedback voltage is lower than the preset current magnitude reference signal, while the current magnitude reference signal provided to each other light-emitting device string is higher than the preset current magnitude reference signal;

a feedback amplifying circuit, configured to receive a reference signal and the minimum feedback voltage of the feedback voltages of light-emitting device strings, and based on the reference signal and the minimum feedback voltage, the feedback amplifying circuit provides a compensation signal; and a pulse generating circuit, configured to receive the compensation signal, and based on the compensation signal, the pulse generating circuit provides a power controlling signal to control power provided to the light-emitting device strings.

10. The light-emitting device driving system of claim 9, further comprising:

a power circuit, configured to receive the power controlling signal and an input voltage, wherein the power circuit converts the input voltage to a driving voltage provided to the light-emitting device strings under the control of the power controlling signal.

11. The light-emitting device driving system of claim 9, further comprising:

a feedback circuit, configured to receive the feedback voltages of the light-emitting device strings, and provide the minimum feedback voltage.

12. The light-emitting device driving system of claim 9, further comprising a plurality of dimming switches, and each dimming switch is coupled in series with one of the light-emitting device strings, wherein the dimming switch is controlled by the associated current magnitude reference signal and the associated current duty cycle reference signal.

13. The light-emitting device driving system of claim 9, wherein each dimming module comprises:

a calculating circuit, configured to receive the preset current duty cycle reference signal, the preset current magnitude reference signal and the feedback voltage of the associated light-emitting device string, wherein based on the preset current duty cycle reference signal, the preset current magnitude reference signal and the feedback voltage of the associated light-emitting device string, the calculating circuit provides the current duty cycle reference signal and the current magnitude reference signal; and a current regulating circuit, configured to receive the feedback voltage, the current duty cycle reference signal and the current magnitude reference signal of the associated light-emitting device string, wherein based on the current duty cycle reference signal, the current regulating circuit controls a duty cycle of a current flowing through the associated light-emitting device string, and wherein based on the feedback voltage and the current magnitude reference signal, the current regulating circuit controls a magnitude of the current flowing through the associated light-emitting device string.

14. The light-emitting device driving system of claim 13, wherein each calculating circuit comprises:

a feedback voltage detecting circuit, configured to receive the feedback voltage of the associated light-emitting device string, and provide a minimum feedback voltage indicating signal indicating if the feedback voltage of the associated light-emitting device string is the minimum feedback voltage; and a current setting circuit, configured to receive the minimum feedback voltage indicating signal, the feedback voltage, the preset current magnitude reference signal and the preset current duty cycle reference signal of the associated light-emitting device string, and based on the minimum feedback voltage indicating signal, the feedback voltage, the preset current magnitude reference signal and the preset current duty cycle reference signal, the current setting circuit provides the current magnitude reference signal and the current duty cycle reference signal.

15. The light-emitting device driving system of claim 13, wherein each calculating circuit comprises:

a feedback voltage detecting circuit, configured to receive a startup enable signal, the feedback voltage of the associated light-emitting device string, and a lower threshold of the feedback voltages, wherein based on the feedback voltage and the lower threshold, the feedback voltage detecting circuit provides a comparison signal, and wherein based on the comparison signal and the startup enable signal, the feedback voltage detecting circuit provides a minimum feedback voltage indicating signal indicating if the feedback voltage of the associated light-emitting device string is the minimum feedback voltage; and a current setting circuit, configured to receive the minimum feedback voltage indicating signal, the comparison signal, the preset current magnitude reference signal and the preset current duty cycle reference signal, wherein based on the minimum feedback voltage indicating signal, the comparison signal, the preset current magnitude reference signal and the preset current duty cycle reference signal, the current setting circuit provides the current magnitude reference signal and the current duty cycle reference signal to control the current flowing through the associated light-emitting device string.

16. The light-emitting device driving system of claim 13, wherein each calculating circuit comprises:

a feedback voltage detecting circuit, configured to receive the feedback voltage of the associated light-emitting device string, and a lower threshold of the feedback voltages, wherein based on the feedback voltage and the lower threshold, the feedback voltage detecting circuit provides a comparison signal; and a current setting circuit, configured to receive the comparison signal, the preset current magnitude reference signal and the preset current duty cycle reference signal, wherein based on the comparison signal, the preset current magnitude reference signal and the preset current duty cycle reference signal, the current setting circuit provides the current magnitude reference signal and the current duty cycle reference signal to control the current flowing through the light-emitting device string.

17. A dimming control method for controlling a plurality of light-emitting device strings, comprising:

receiving a preset current magnitude reference signal and a preset current duty cycle reference signal;

detecting a minimum feedback voltage from feedback voltages of the light-emitting device strings;

clamping the minimum feedback voltage to a lower threshold by regulating a current flowing through the associated light-emitting device string;

decreasing the current magnitude reference signal of the light-emitting device string with the minimum feedback voltage from the preset current magnitude reference signal;

increasing the current magnitude reference signal of the light-emitting device string without the minimum feedback voltage from the preset current magnitude reference signal; and adjusting a current duty cycle reference signal according to the current magnitude reference signal to maintain the current flowing through the associated light-emitting device string being a preset value; wherein the preset value of the current flowing through the light-emitting device string is proportional to a product of the preset current magnitude reference signal and the preset current duty cycle reference signal.

18. The dimming control method of claim 17, wherein decreasing the current magnitude reference signal of the light-emitting device string with the minimum feedback voltage from the preset current magnitude reference signal further comprises stopping regulating the current magnitude reference signal of the associated light-emitting device string when one of the following conditions is met:

(1) the current magnitude reference signal of the associated light-emitting device string reaches a lower limit of the current magnitude reference signal; and (2) the current duty cycle reference signal of the associated light-emitting device string reaches an upper limit of the current duty cycle reference signal.

19. The dimming control method of claim 17, wherein increasing the current magnitude reference signal of the light-emitting device string without the minimum feedback voltage from the preset current magnitude reference signal further comprises stopping regulating the current magnitude reference signal of the associated light-emitting device string without the minimum feedback voltage when one of the following conditions is met:

(1) the current magnitude reference signal of the associated light-emitting device string reaches an upper limit of the current magnitude reference signal;

(2) the current duty cycle reference signal of the associated light-emitting device string reaches a lower limit of the current duty cycle reference signal; and (3) the feedback voltage of the associated light-emitting device string reaches the lower threshold.

* * * * *